US012577738B2

(12) United States Patent
Meier et al.

(10) Patent No.: US 12,577,738 B2
(45) Date of Patent: Mar. 17, 2026

(54) ROLLER TOOL FOR A SOIL PROCESSING ROLLER

(71) Applicant: Hamm AG, Tirschenreuth (DE)

(72) Inventors: Matthias Meier, Tirschenreuth (DE); Johannes Malzer, Tirschenreuth (DE)

(73) Assignee: HAMM AG, Tirschenreuth (DE)

( * ) Notice: Subject to any disclaimer, the term of this patent is extended or adjusted under 35 U.S.C. 154(b) by 758 days.

(21) Appl. No.: 17/969,009

(22) Filed: Oct. 19, 2022

(65) Prior Publication Data

US 2023/0127739 A1 Apr. 27, 2023

(30) Foreign Application Priority Data

Oct. 22, 2021 (DE) ..... 10 2021 127 441.9

(51) Int. Cl.
*E01C 19/23* (2006.01)
*E02D 3/026* (2006.01)

(52) U.S. Cl.
CPC ..... *E01C 19/236* (2013.01); *E02D 3/026* (2013.01)

(58) Field of Classification Search
CPC ..... E01C 19/236; E02D 3/026; E02F 9/28
USPC ..... 404/121, 124; 172/122, 540, 554; 299/32, 102, 103
See application file for complete search history.

(56) References Cited

U.S. PATENT DOCUMENTS 3,099,191 A * 7/1963 Averette ..... E02D 3/026 404/121
3,822,957 A * 7/1974 Caron ..... E02D 3/026 172/554
4,062,552 A 12/1977 Kitaguchi
4,212,559 A * 7/1980 Persson ..... B23B 31/113 403/379.5

(Continued)

FOREIGN PATENT DOCUMENTS

CN 103205958 B 5/2015
CN 106346313 B 7/2018

(Continued)

OTHER PUBLICATIONS

Chinese Office action filed in CN Application No. 2022112940794 dated Apr. 25, 2025.

(Continued)

*Primary Examiner* — Raymond W Addie
(74) *Attorney, Agent, or Firm* — RANKIN, HILL & CLARK LLP

(57) ABSTRACT

A roller tool for a soil processing roller of a soil processing machine incudes a tool holder to be fixed on an outer peripheral side of a carrier casing. The tool holder has an attachment region for fixed attachment on an outer peripheral surface of the carrier casing and a tool holder opening elongated in the direction of an opening longitudinal axis for accommodating a replaceable tool shaft of a replaceable tool to be detachably fixed on the tool holder. The tool holder includes a first tool holder part, wherein the attachment (Continued)

region is provided completely on the first tool holder part, and a second tool holder part to be detachably attached to the first tool holder part. The second tool holder part, together with the first tool holder part, delimits the tool holder opening in the circumferential direction around the opening longitudinal axis.

19 Claims, 8 Drawing Sheets

(56) References Cited

U.S. PATENT DOCUMENTS

| | | | | |
|---|---|---|---|---|
| 6,682,262 | B2 * | 1/2004 | Caron | E02D 3/026 404/124 |
| 9,206,576 | B2 * | 12/2015 | Meier | E02D 3/026 |
| 9,376,775 | B2 * | 6/2016 | Meier | E01C 19/236 |
| 9,382,673 | B2 * | 7/2016 | Meier | E02D 3/039 |
| 11,959,244 | B2 * | 4/2024 | Meier | E02F 3/20 |
| 2002/0114667 | A1 * | 8/2002 | Kaldenberg | E02D 3/026 404/124 |
| 2004/0033107 | A1 * | 2/2004 | Caron | E02D 3/026 404/124 |
| 2005/0225162 | A1 * | 10/2005 | Gibbins | E02D 3/026 301/43 |

FOREIGN PATENT DOCUMENTS

| | | | |
|---|---|---|---|
| CN | 207770855 | U | 8/2018 |
| CN | 210080750 | U | 2/2020 |
| CN | 219240243 | U | 6/2023 |
| DE | 102013217042 | | 3/2015 |
| DE | 102013217043 | | 3/2015 |
| EP | 1283924 | | 2/2003 |
| EP | 3023547 | | 5/2016 |
| EP | 3093393 | | 11/2016 |

OTHER PUBLICATIONS

German Search Report filed in DE 10 2021 127 441.9 dated Aug. 4, 2022.

* cited by examiner

ROLLER TOOL FOR A SOIL PROCESSING ROLLER

The present invention relates to a roller tool for a soil processing roller of a soil processing machine.

A roller tool for a soil processing roller is known from EP 3 093 393 A1, which comprises a tool holder fixed with its attachment region by welding on an outer peripheral surface of a roller casing of a soil processing roller. In the integrally formed tool holder, a tool holder opening is formed into which a replaceable tool shaft of a tool designed as a chisel, for example, is inserted by moving it in the direction of an opening longitudinal axis of the tool holder opening and locked therein by locking. The replaceable tool can be pressed out of the tool holder opening by means of a tool that is to be inserted through a lateral opening in the tool holder part and positioned behind the replaceable tool shaft.

A roller tool for a soil processing machine is known from DE 10 2013 217 042 A1, which comprises a tool holder fixed with its attachment region by welding on an outer peripheral surface of a roller casing of a soil processing roller. In the tool holder, a tool holder opening is formed into which a replaceable tool shaft of a replaceable tool designed as a chisel, for example, is inserted by moving it in the direction of an opening longitudinal axis of the tool holder opening. To lock the replaceable tool on the tool holder, closure elements are inserted from both sides into lateral openings provided on the tool holder, which on the one hand close the lateral openings provided in the tool holder against the penetration of dirt and on the other hand engage with the replaceable tool shaft and thus lock the replaceable tool on the tool holder.

The object of the present invention is to provide a roller tool for a soil processing roller of a soil processing machine, in which a replaceable tool can be reliably fixed on a tool holder and can be easily detached from the tool holder even after a long operating period.

According to the invention, this object is achieved by a roller tool for a soil processing roller of a soil processing machine, comprising a tool holder to be fixed on an outer peripheral side of a carrier casing, wherein the tool holder has an attachment region for firm attachment to an outer peripheral surface of the carrier casing and comprises a tool holder opening elongated in the direction of an opening longitudinal axis for accommodating a replaceable tool shaft of a replaceable tool to be detachable fixed on the tool holder.

The tool holder comprises:

- a first tool holder part, wherein the attachment region is completely provided on the first tool holder part,
- a second tool holder part to be detachably attached to the first tool holder part, wherein the second tool holder part, together with the first tool holder part, delimits the tool holder opening in the circumferential direction around the opening longitudinal axis.

In the case of the roller tool constructed according to the invention, the two tool holder parts together take on the function of stable and reliable locking of a respective roller tool on the tool holder, while only one of the two tool holder parts, which are structurally different from one another, is used to firmly attach the tool holder to a carrier casing. This enables the tool holder to be fixed on a carrier casing in a stable manner that is resistant to the massive effects that occur during working operation, while a replaceable tool held on such a tool holder can be detached from it in a simple manner by removing the tool holder part that is not connected to the carrier casing and thus releasing the replaceable tool.

For stable mounting of a replaceable tool, it is proposed that the first tool holder part delimits the tool holder opening in the circumferential direction around the opening longitudinal axis in a first peripheral region, that the second tool holder part delimits the tool holder opening in the circumferential direction around the opening longitudinal axis in a second peripheral region, and that the first peripheral region is larger than the second peripheral region.

In order to prevent a replaceable tool from becoming detached from a tool holder during operation, a replaceable tool holding formation can be provided on the tool holder, wherein for a structure that is easy to implement, the replaceable tool holding formation is preferably provided only on the first tool holder part.

In order to provide a stable holding interaction between a tool holder and a replaceable tool over a larger peripheral region, the replaceable tool holding formation can be formed extending around the opening longitudinal axis essentially in the first peripheral region.

The roller tool according to the invention can furthermore comprise a replaceable tool having a replaceable tool shaft to be received in the tool holder opening, wherein a counter holding formation for engagement with the replaceable tool holding formation is provided on the replaceable tool shaft.

A stable form fit between a tool holder and a replaceable tool held on it can be achieved, for example, by the replaceable tool holding formation comprising a holding projection protruding radially inwards with respect to the opening longitudinal axis, and by the counter holding formation having a holding recess set back radially inwards with respect to a shaft longitudinal axis of the replaceable tool.

In order to protect the second tool holder part, which is not attached to a carrier casing, against external effects, a tool holder part receptacle recess for accommodating the second tool holder part can be formed on the first tool holder part.

A stable connection of the two tool holder parts to one another can be achieved, for example, in that the second tool holder part is fixed on the first tool holder part by a plurality of fasteners.

For this purpose, in at least one tool holder part of first tool holder part and second tool holder part, a fastener passage opening can be provided in association with at least one fastener, and in the other tool holder part of the first tool holder part and second tool holder part, a fastener formfitting engagement opening can be provided in association with each fastener passage opening of the one tool holder part.

A high level of stability of the assembly can be ensured in that at least one fastener passage opening is provided in the one tool holder part, preferably the first tool holder part, on both sides of the tool holder opening.

In order to support defined positioning of a replaceable tool with respect to a tool holder, a replaceable tool support region facing away from the attachment region can be provided on the tool holder.

For this purpose, the replaceable tool support region can comprise a replaceable tool support surface that preferably essentially completely surrounds the tool holder opening, wherein a first replaceable tool support surface part is provided on the first tool holder part and a second replaceable tool support surface part is provided on the second tool holder part.

In order to avoid relative movements between a replaceable tool and a tool holder part that result in severe wear during working operation, it is proposed that when the replaceable tool holding formation is engaged with the counter holding formation, the replaceable tool is pretensioned in contact with the replaceable tool support region.

The invention furthermore relates to a soil processing roller, comprising a plurality of roller tools constructed according to the invention, wherein the first tool holder parts of the roller tools are firmly connected to a carrier casing by welding, preferably in each case a weld seam surrounding the attachment region of a respective first tool holder part essentially without interruption.

The carrier casing can be, for example, a roller casing of the soil processing roller. In an alternative embodiment, the carrier casing can be a cladding casing to be arranged surrounding the roller casing of the soil processing roller, which is arranged surrounding a roller casing of a soil processing roller having a substantially unstructured outer peripheral surface to carry out a corresponding soil processing procedure.

The invention furthermore relates to a soil processing machine having at least one soil processing roller constructed according to the invention.

The invention furthermore relates to a method for attaching a replaceable tool to a tool holder of a roller tool constructed according to the invention, preferably to a soil processing roller constructed according to the invention or a soil processing machine constructed according to the invention, comprising the following measures:

a) with the second tool holder part removed from the first tool holder part, inserting a replaceable tool shaft of the replaceable tool into a part of the tool holder opening formed in the first tool holder part,
b) during or after measure a), attaching the second tool holder part to the first tool holder part.

In measure a), the replaceable tool shaft can be inserted into the part of the tool holder opening formed in the first tool holder part by moving it transversely to the opening longitudinal axis of the tool holder opening.

In contrast to roller tools known from the prior art, according to the invention a replaceable tool is not inserted into an associated tool holder opening by moving it in the direction of a shaft longitudinal axis, but rather by moving it transversely, for example essentially orthogonally to the shaft longitudinal axis, wherein possibly a form fit acting in the direction of the shaft longitudinal axis can also be generated simultaneously between the tool holder part and the replaceable tool.

The present invention is described in detail below with reference to the attached figures. In the figures.

Figure 1:
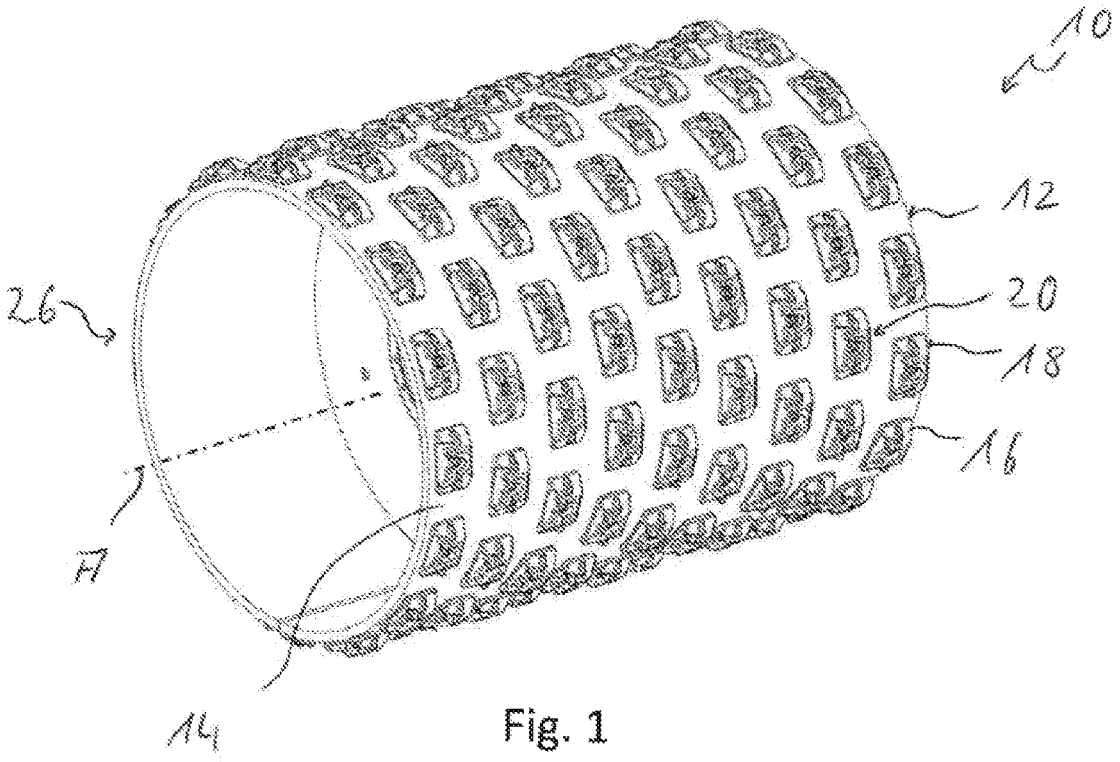
FIG. 1 shows a perspective view of a soil processing roller having a plurality of first tool holder parts of tool holders carried on an outer peripheral surface of a roller casing.

In FIG. 1, a soil processing roller for a soil processing machine constructed, for example, in the manner of a soil compactor is generally denoted by 10. The soil processing roller 10 comprises a roller casing 12 surrounding a roller axis of rotation A and having an outer peripheral surface 14. A plurality of first tool holder parts 16 of tool holders, generally denoted by 18, of roller tools, generally denoted by 20, are fixed by welding on the outer peripheral surface 14 of the roller casing 12. The first tool holder parts 16 are arranged in a plurality of rings in succession in the direction of the roller axis of rotation A, in succession in the peripheral direction, wherein the first tool holder parts 16 that are arranged in rings in direct succession in the axial direction are arranged offset from one another in the peripheral direction.

Figure 2:
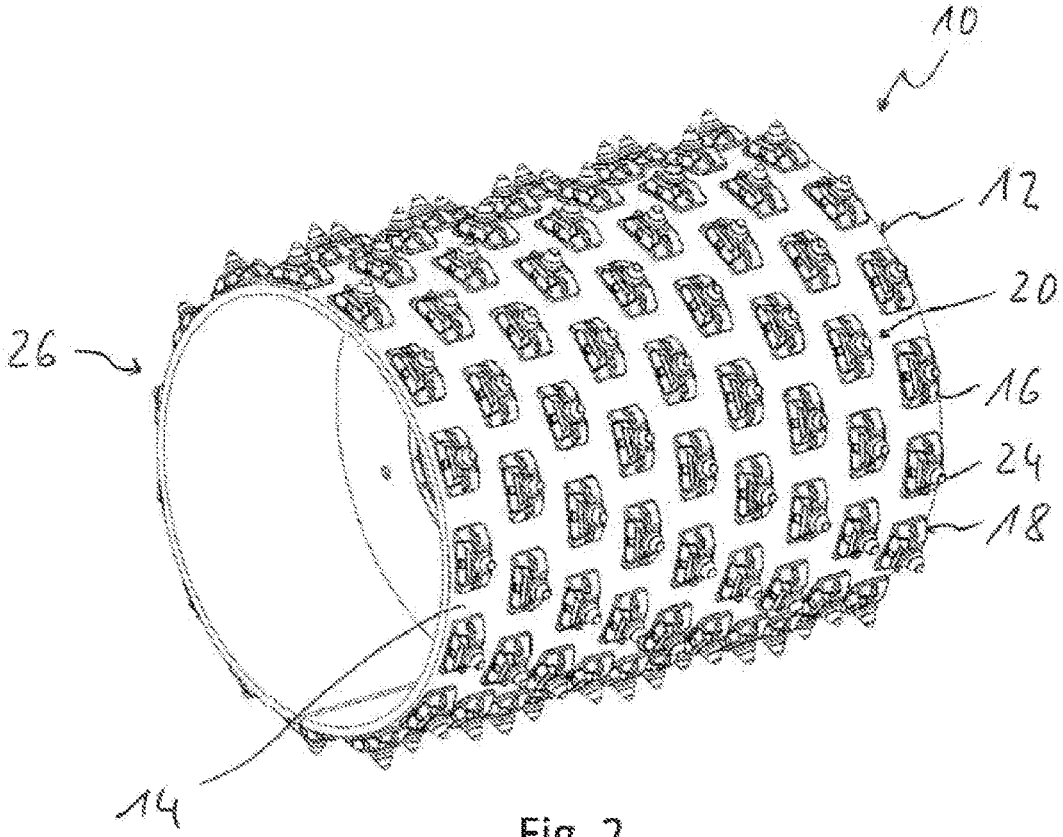
FIG. 2 shows the soil processing roller of FIG. 1 having replaceable tools designed as chisels attached to the tool holders.

FIG. 2 shows the soil processing roller 10 of FIG. 1 having the complete roller tools 20. In addition to the first tool holder parts 16 fixed by welding on the roller casing 12, these comprise second tool holder parts 22 and replaceable tools 24 in the form of chisels held by them on the first tool holder parts 16.

Figure 3:
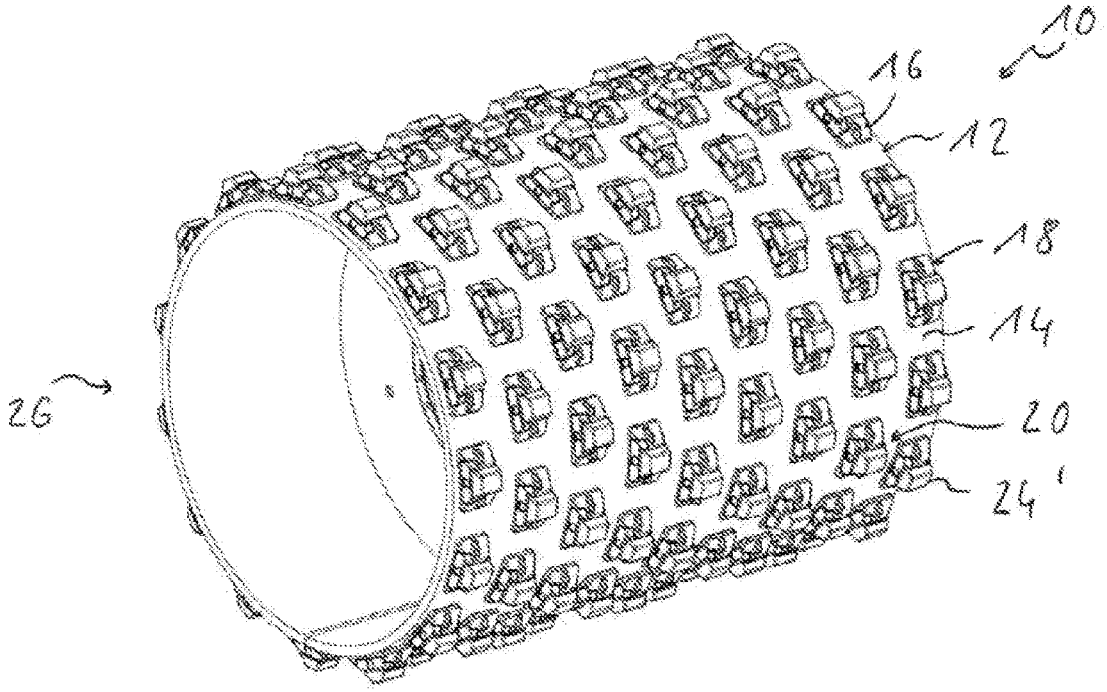
FIG. 3 shows the soil processing roller of FIG. 1 having replaceable tools designed as pad feet attached to the tool holders.
Figure 4:
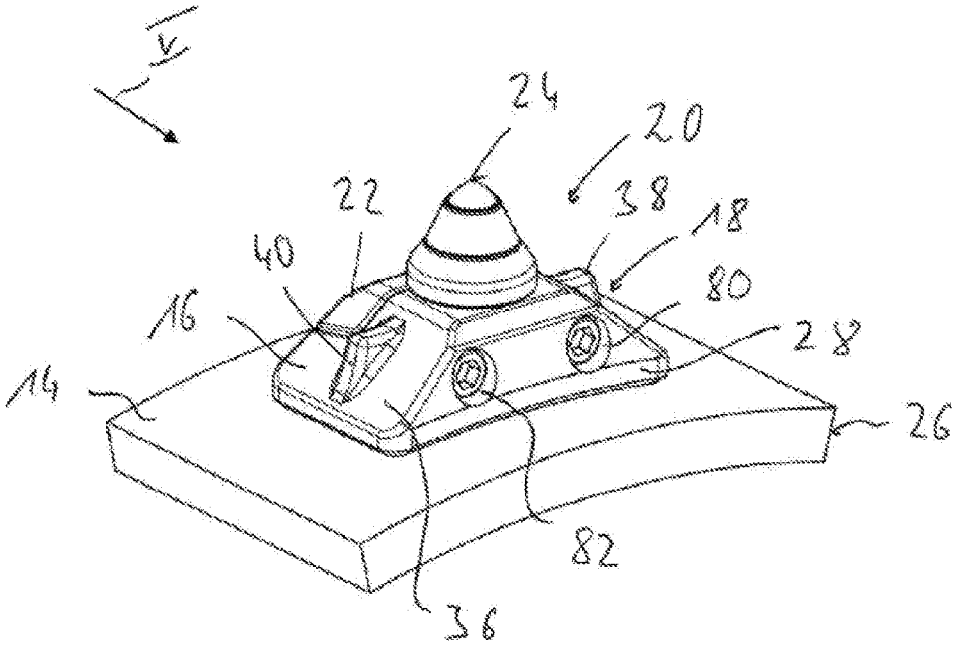
FIG. 4 shows a perspective view of a roller tool on a carrier casing in viewing direction IV in FIG. 5.
Figure 5:
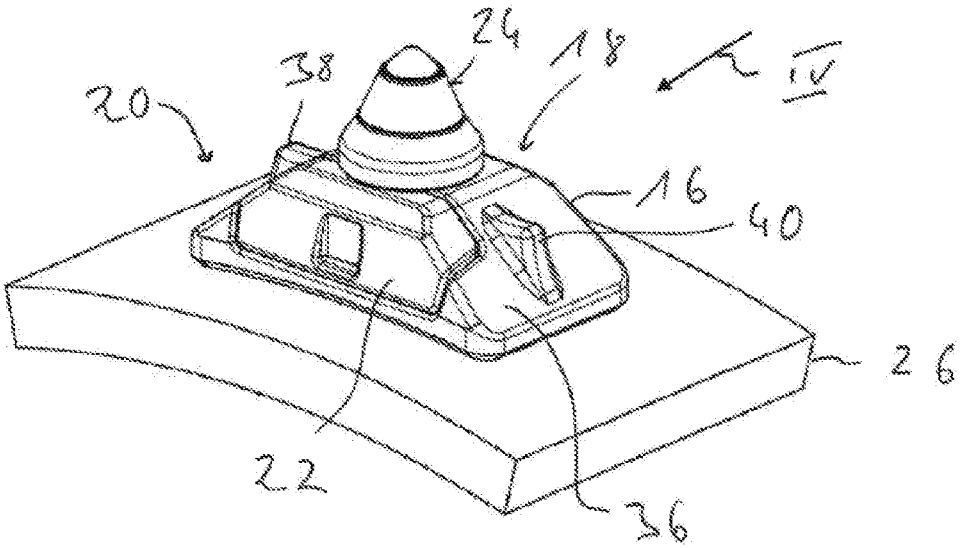
FIG. 5 shows the roller tool of FIG. 4 in viewing direction V in FIG. 4.
Figure 6:
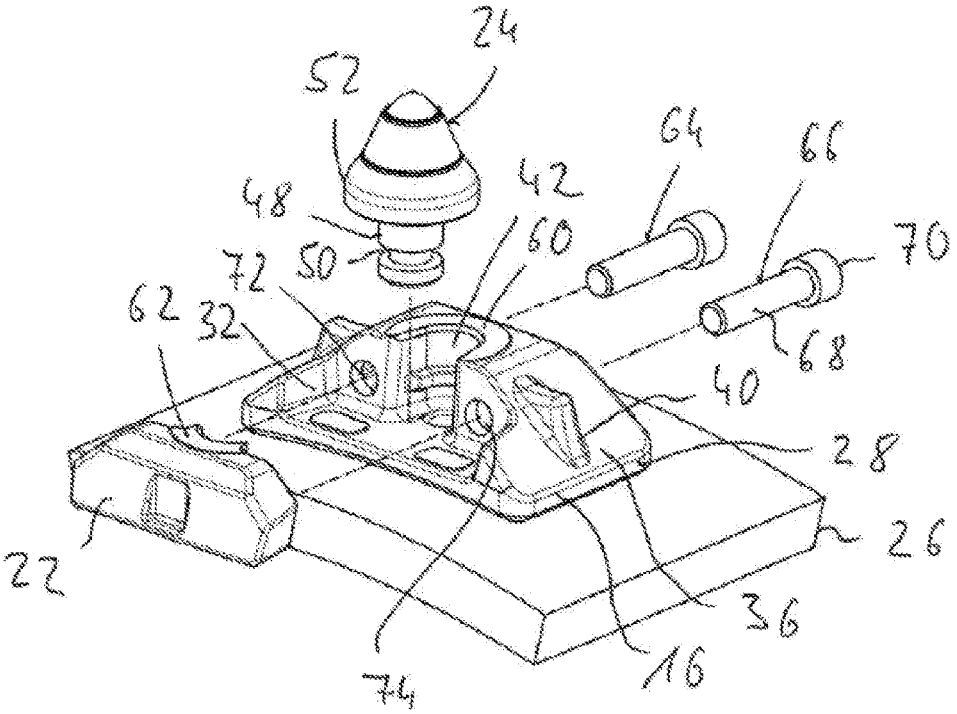
FIG. 6 shows the roller tool of FIGS. 4 and 5 in an exploded view.
Figure 7:
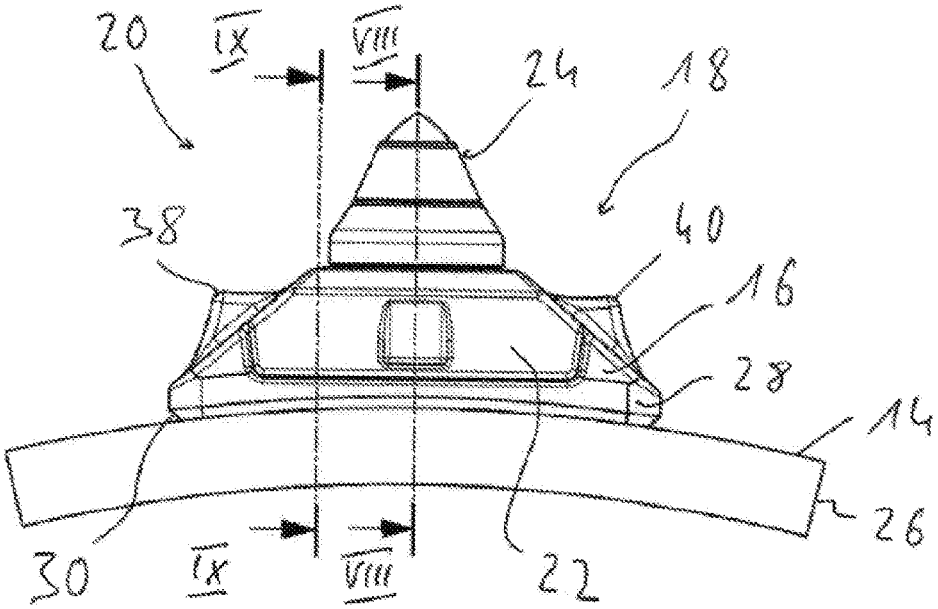
FIG. 7 shows a side view of the roller tool of FIGS. 4 and 5.
Figure 8:
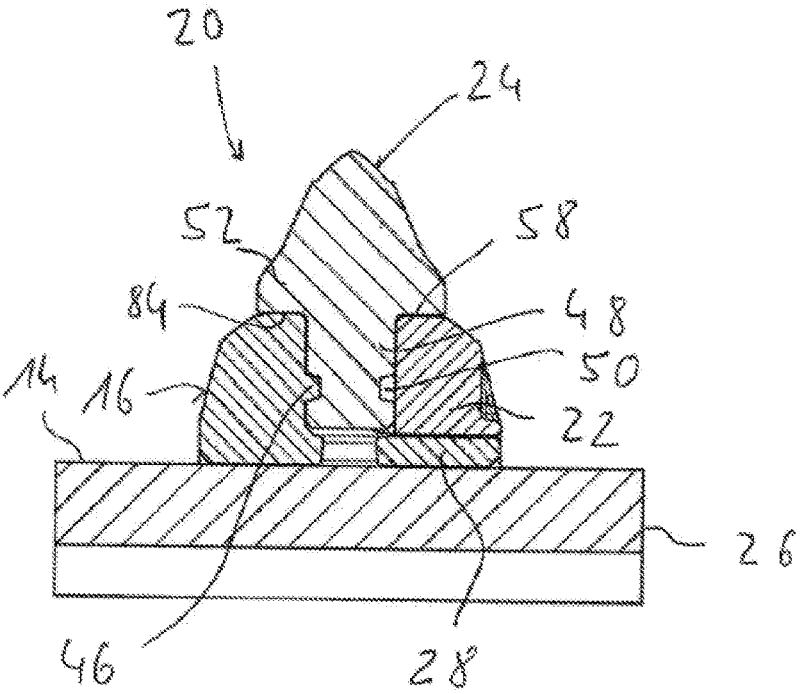
FIG. 8 shows a sectional view of the roller tool of FIGS. 4 and 5, in section along a line VIII-VIII in FIG. 7.
Figure 9:
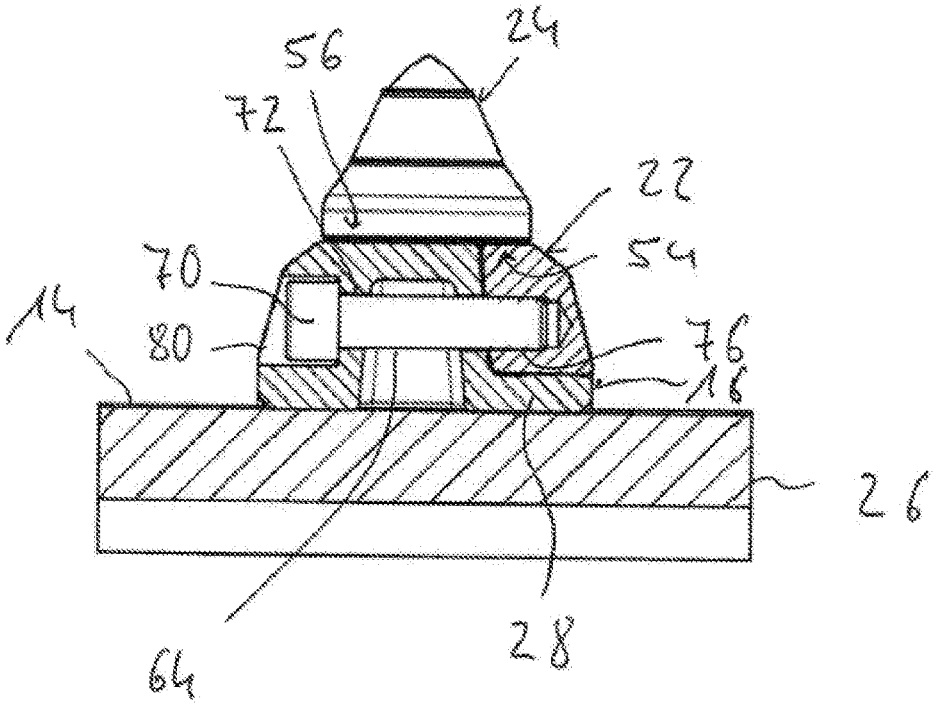
FIG. 9 shows a sectional view of the roller tool of FIGS. 4 and 5, in section along a line IX-IX in FIG. 7.

In the case of the soil processing roller 10 shown in FIG. 3, the roller tools 20 comprise roller tools 24' carried on the tool holders 18 in the form of pad feet.

Before the structure of the roller tools 20, i.e., the structure of the tool holder 18 and the replaceable tools 24 or 24', is discussed in more detail below, it is to be noted that in the soil processing rollers 10 shown in FIGS. 1 to 3, the tool holders 18 of the roller tools 20 are fixed directly on the roller casing 12 providing a carrier casing 26. In an alternative embodiment, a cladding casing constructed, for example, having a plurality of shell segments could be used as the carrier casing 26, which can be arranged surrounding the roller casing 12 of such a soil processing roller 10 if necessary.

In FIGS. 4 to 10, the roller tool 20 or the various components of the roller tool 20 can be seen partially assembled and partially individually. The roller tool 20 includes the first tool holder part 16 produced, for example, from a cast or forged component. This component has a plate-shaped attachment region 28 to be fixed on the outer peripheral surface 14 by welding and adapted to the curved outer peripheral contour of the carrier casing 16. It can be seen in FIG. 11 that the attachment region 28 is essentially surrounded in its entire peripheral region by a chamfer 30, so that the first tool holder part 16 can be fixed on the carrier casing 26 or on the outer peripheral surface 14 by a weld seam that preferably extends completely around the attachment region 28 and engages in the chamfer 30. In this way, a stable, solid bond is created between the carrier casing 26 and the first tool holder part 16.

Figure 10:
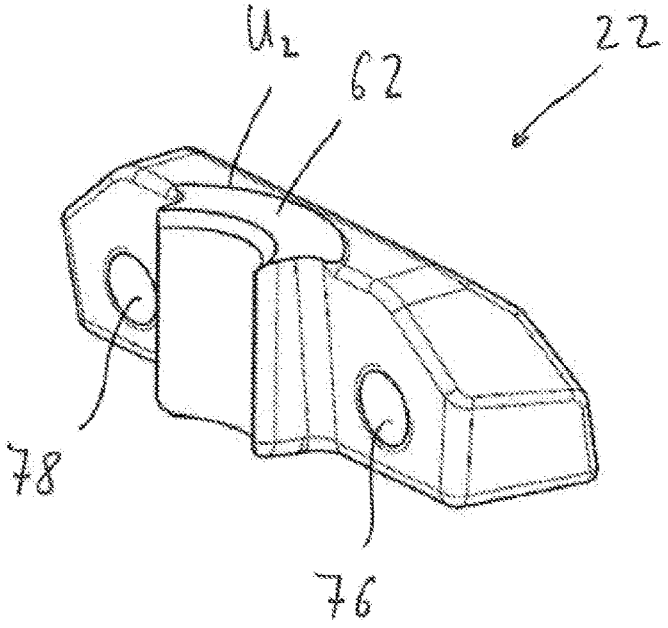
FIG. 10 shows a perspective view of a second tool holder part of the roller tool of FIGS. 4 and 5.
Figure 11:
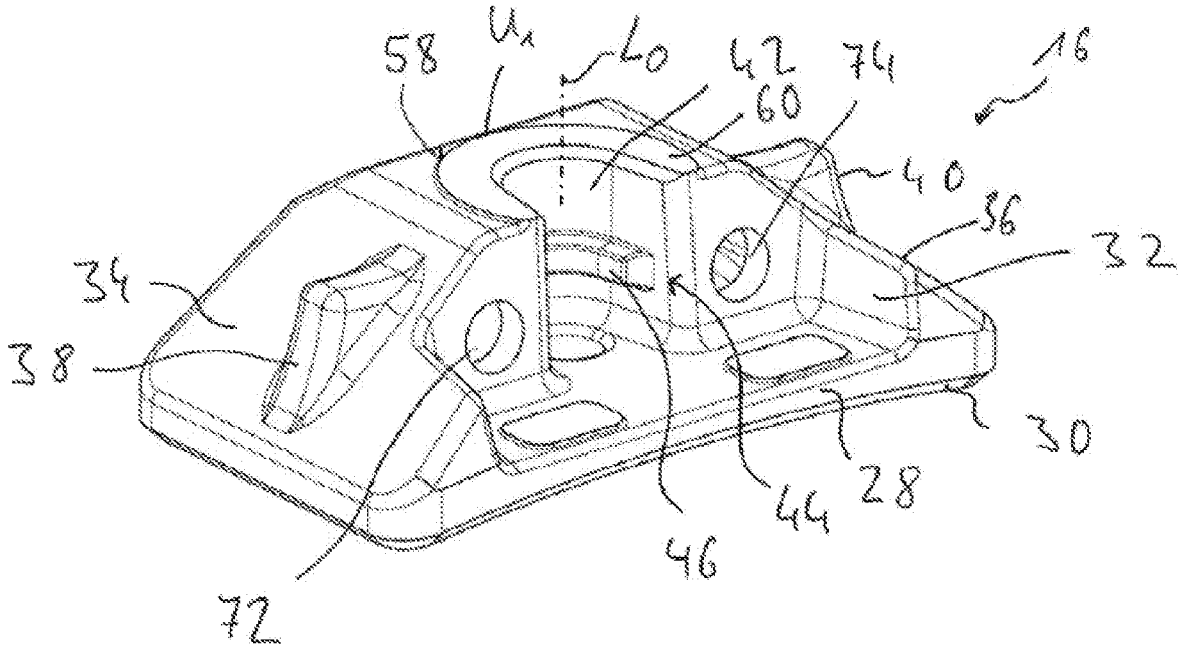
FIG. 11 shows a perspective view of a first tool holder part of the roller tool of FIGS. 4 and 5.

The roller tool 20 or its tool holder 18 furthermore comprises the second tool holder part 22 shown in FIG. 10. On the first tool holder part 16, a tool holder part receptacle recess 32 is formed which is open on one side and in the direction away from the attachment region 28 and in which, in the assembled state, the second tool holder part 22 is accommodated in such a way that, together with the first tool holder part, it provides a flush transition between these two tool holder parts 16, 22 and in the transition between these two tool holder parts 16, 22 there are essentially no steps that could result in damage, in particular to the second tool holder part 22.

On end faces 34, 36 of the first tool holder part 16, which are oriented in a longitudinal direction of the first tool holder part 16 and, when attached to a soil processing roller 10 or a carrier casing 26, are oriented in the circumferential direction, there are breaking projections 38, 40 that protrude radially outwards in the circumferential direction or with respect to the roller axis of rotation A, which, in particular when replaceable tools 24 designed as chisels are used, additionally contribute to the crushing of the soil to be broken up.

A tool holder opening, generally denoted by 42, is formed in the tool holder 18. This is elongated in the direction of an opening longitudinal axis $L_O$ and is therefore open radially outwards with respect to the roller axis of rotation A when the tool holder 18 is attached to a carrier casing 26. In the assembled state of the two tool holder parts 16, 18, the tool holder opening 42 is delimited by the two tool holder parts 16, 22 in the circumferential direction. The first tool holder part 16 delimits the tool holder opening 42 in a first peripheral region $U_1$. The second tool holder part 22 delimits the tool holder opening 42 in the remaining second peripheral region $U_1$, which, as the combination of FIGS. 10 and 22 make clear, is significantly smaller than the first peripheral region $U_2$.

When the second toolholder part 22 is not attached to the first toolholder part 16, the tool holder opening 42 formed largely in the first toolholder part 16 or the part thereof formed in the first toolholder part 16 is open transversely to the opening longitudinal axis $L_O$, in particular to the tool holder part receptacle recess 32. The toolholder 24 or 24' is therefore inserted laterally, i.e., transversely with respect to the opening longitudinal axis $L_O$, into the part of the tool holder opening 42 formed in the first tool holder part 16 when a roller tool 20 is assembled.

In order to achieve stable cohesion of a replaceable tool 24 or 24' with the tool holder 18 or the first tool holder part 16 in the direction of the opening longitudinal axis $L_O$, a replaceable tool holding formation generally denoted by 44 is provided on the first tool holder part 16. This comprises a holding projection 46 that protrudes radially inwards with respect to the opening longitudinal axis $L_O$ and extends, for example, over the first peripheral region $U_1$.

Figure 12:
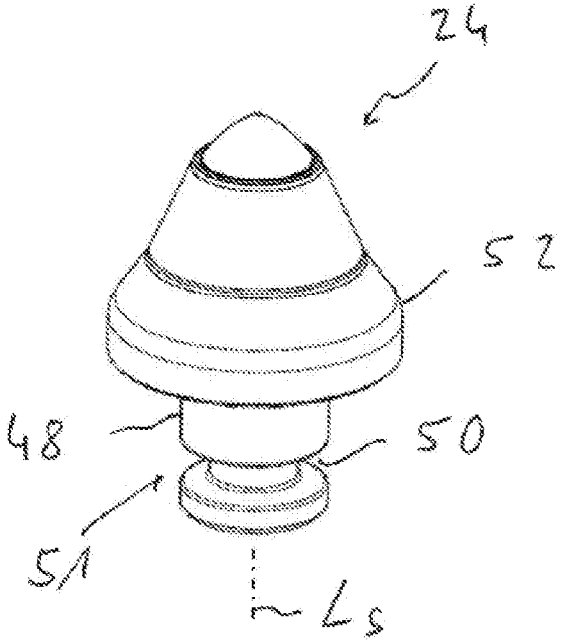
FIG. 12 shows a perspective view of a replaceable tool designed as a chisel.

On a replaceable tool shaft 48 of the replaceable tool 24 shown, for example, in FIG. 12 and designed in the form of a chisel, in association with the replaceable tool holding formation 44 or the holding projection 46, a counter holding formation 51 is formed having a holding recess 50 set back radially inwards with respect to a shaft longitudinal axis $L_S$. Complementary to the structure of the holding projection 46 tapering radially inward with respect to the opening longitudinal axis $L_O$, the holding recess 50 also has a structure that tapers radially inwards, for example, tapering conically, with respect to the shaft longitudinal axis $L_S$.

When, for example, the replaceable tool 24 shown in FIG. 12 is inserted laterally into the first tool holder part 16, the holding projection 46 enters the holding recess 50. Due to the interaction of the holding projection 46, which tapers and thus generates a wedge effect, with the holding recess 50, the replaceable tool 24 is moved in the direction of the opening longitudinal axis $L_O$ or the shaft longitudinal axis $L_S$ in the direction of the first tool holder part 16 or its attachment region 28, i.e., when it is attached to a soil processing roller 10, it is pre-tensioned radially inward with respect to the roller axis of rotation A. The replaceable tool 24 comes into contact with a counter support region 54 thereof formed on a body region 52 against a replaceable tool support region 56 formed on the tool holder 18.

The replaceable tool support region 56 comprises a ring-like replaceable tool support surface 58 essentially completely surrounding the replaceable tool opening 42. A first support surface part 60 of the replaceable tool support surface is formed on the first tool holder part 16, and a second replaceable tool support surface part 62 is formed on the second tool holder part 22. In accordance with the different extension lengths of the first and second peripheral regions $U_1$, $U_2$ around the opening longitudinal axis $L_O$, the first and second replaceable tool support surface parts 60, 62 are also dimensioned differently in the peripheral direction around the opening longitudinal axis $L_O$.

The second tool holder part 22 is fixed on the first tool holder part 16 by two fasteners 64, 66 formed, for example, as screw bolts. Each of these fasteners 64, 66 comprises an externally threaded shaft 68 having a head 70. Associated with each fastener 64, 66, in the first tool holder part 18 a fastener passage opening 72, 74 is formed, through which the externally threaded shaft 68 of a respective fastener 64, 66 can be guided. Furthermore, associated with each fastener 64, 66 or each fastener passage opening 72, 74 in the first tool holder part 16, a fastener formfitting engagement opening 76, 78 is formed in the second tool holder part 22. The fastener formfitting engagement openings 76, 78 can be formed as internally threaded openings into which the shafts 68 of the fasteners 64, 66 can be screwed when the second tool holder part 22 is arranged in the tool holder part receptacle recess 32, in order in this way to clamp the second tool holder part 22 firmly against the first tool holder part 16.

In order to be able to accommodate the fasteners 64, 66 completely in the tool holder 18, expanded head receptacle regions 80, 82 are provided in the region of the fastener passage openings 72, 74, into which the heads 70 of the fasteners 64, 66 can plunge completely.

It can be seen in FIG. 10 that no part of the holding formation 44 of the tool holder 18 is formed on the second tool holder part 22. The second tool holder part 22 is therefore essentially used to press the replaceable tool shaft 48 laterally into that part of the tool holder opening 42 formed in the first tool holder part 16 and, in the process, to press the holding projection 46 of the first tool holder part 16 into the holding recess 50 of the replaceable tool shaft 48 and thus continue to press the replaceable tool 24, which is designed as a chisel, for example, with its counter support region 54 against the replaceable tool support region 56. The counter support region 54 is essentially provided by a ring-like surface 84 on the replaceable tool body 52 that surrounds the replaceable tool shaft 48 and is oriented essentially orthogonally to the shaft longitudinal axis $L_S$.

Figure 13:
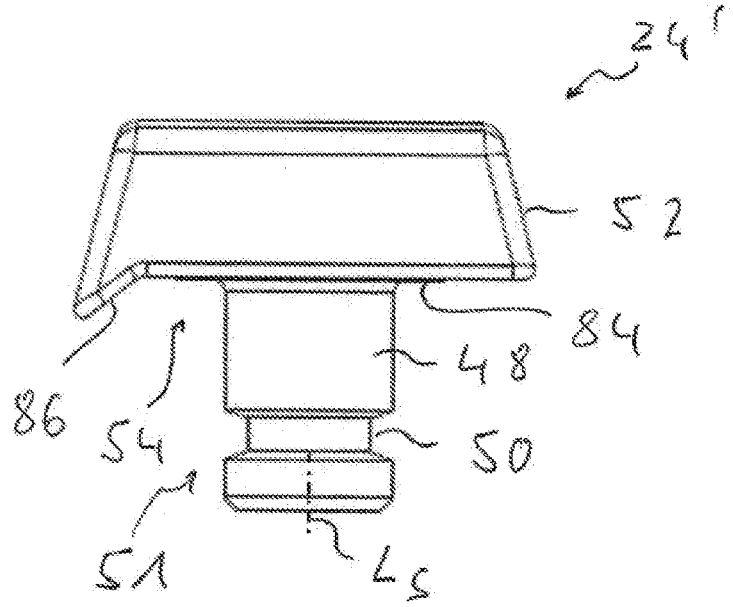
FIG. 13 shows a side view of a replaceable tool designed as a pad foot.
Figure 14:
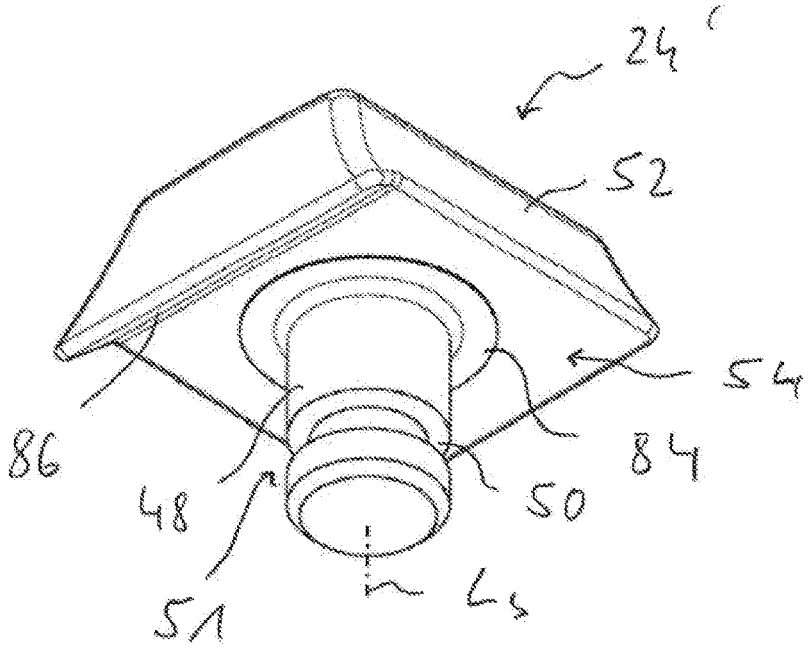
FIG. 14 shows a perspective view of the replaceable tool of FIG. 13.
Figure 15:
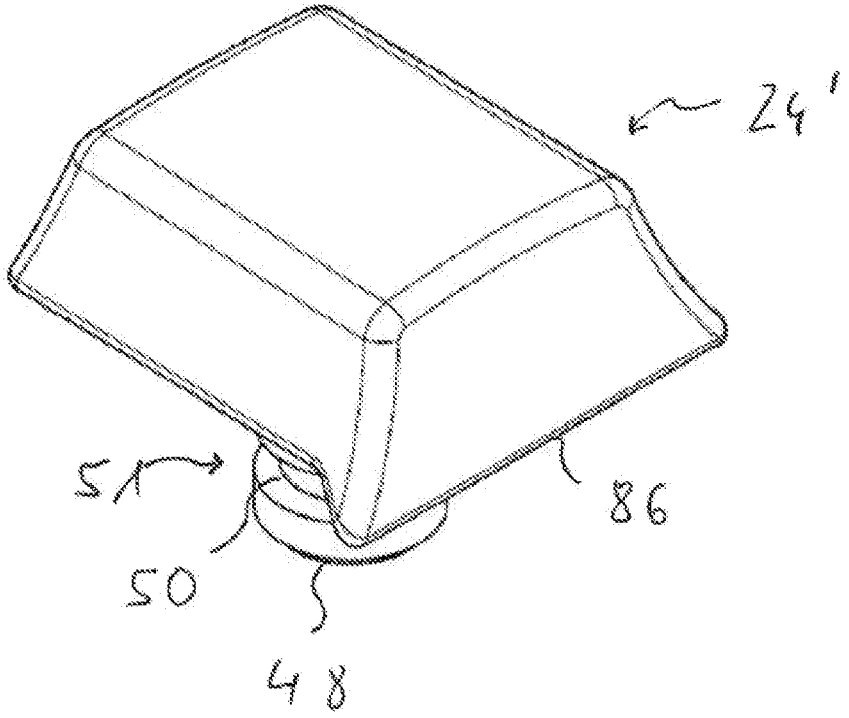
FIG. 15 shows another perspective view of the replaceable tool of FIG. 13.

A replaceable tool 24' designed as a pad foot is shown in more detail in FIGS. 13 to 15. This also has a replaceable tool body 52 providing the pad foot structure, from which the replaceable tool shaft 48 having the holding recess 50 formed therein extends. In this replaceable tool 24', a surface 84 formed on the replaceable tool body 52 and essentially surrounding the replaceable tool shank 48 with a ring-like structure and protruding somewhat, for example in the direction of the shaft longitudinal axis $L_S$, also provides the counter support region 54 to be supported on the replaceable tool support surface 58.

An anti-rotation projection 86 is provided on a peripheral side of the replaceable tool body 52. In the assembled state, this engages over the second tool holder part 22 and thus prevents the replaceable tool 24' from rotating around the shaft longitudinal axis $L_S$.

When attaching such a replaceable tool 24' designed as a pad foot to the tool holder 18, as described above, the replaceable tool shaft 48 is inserted laterally into the first tool holder part 16, so that the holding projection 46 and the holding recess 50 enter. In order to prevent mutual interference of the anti-rotation projection 86 with the second tool holder part 22, before the replaceable tool shaft 48 is laterally inserted into the tool holder opening 42, the second tool holder part 22 is positioned on the replaceable tool 24' in such a way that the anti-rotation projection 86 already overlaps the second tool holder part 22. The second tool holder part 22 and the replaceable tool 24' are then moved together towards the first tool holder part 16, so that the replaceable tool shaft 48 laterally enters the part of the tool holder opening 42 formed in the first tool holder part, and the second tool holder part 22 essentially simultaneously enters the tool holder part receptacle recess 32. Thereafter, the two tool holder parts 16, 22 holding the replaceable tool together can be fixed on one another by the fasteners 64, 66.

The invention claimed is:

1. A roller tool for a soil processing roller of a soil processing machine, comprising a tool holder configured to be firmly attached on an outer peripheral side of a carrier casing and to detachably hold a replaceable tool, wherein the tool holder has an attachment region for firm attachment to an outer peripheral surface of the carrier casing and a tool holder opening elongated in the direction of an opening longitudinal axis for accommodating a tool shaft of the replaceable tool to be detachably held on the tool holder, wherein the tool holder comprises:

a first tool holder part, wherein the attachment region is completely provided on the first tool holder part, a second tool holder part to be detachably attached to the first tool holder part, wherein the second tool holder part, together with the first tool holder part, delimits the tool holder opening in the circumferential direction around the opening longitudinal axis.

2. The roller tool as claimed in claim 1, wherein the first tool holder part delimits the tool holder opening in the circumferential direction around the opening longitudinal axis in a first peripheral region, the second tool holder part delimits the tool holder opening in the circumferential direction around the opening longitudinal axis in a second peripheral region, and the first peripheral region is larger than the second peripheral region.

3. The roller tool as claimed in claim 2, wherein the tool holding formation is formed in the first peripheral region extending around the opening longitudinal axis.

4. The roller tool as claimed in claim 1, wherein a tool holding formation for holding the replaceable tool at the tool holder is provided on the tool holder.

5. The roller tool as claimed in claim 4, wherein the tool holding formation is provided only on the first tool holder part.

6. The roller tool as claimed in claim 4, wherein the replaceable tool having the tool shaft to be accommodated in the tool holder opening includes a counter holding formation for engagement with a tool retaining formation provided on the tool shaft.

7. The roller tool as claimed in claim 6, wherein the tool holding formation comprises a holding projection protruding radially inwards with respect to the opening longitudinal axis, and wherein the counter holding formation comprises a holding recess set back radially inwards with respect to a shaft longitudinal axis of the tool shaft.

8. The roller tool as claimed in claim 1, wherein a tool holder part receptacle recess for receiving the second tool holder part is formed on the first tool holder part.

9. The roller tool as claimed in claim 1, wherein the second tool holder part is to be fixed by a plurality of fasteners on the first tool holder part.

10. The roller tool as claimed in claim 9, wherein in at least one tool holder part of first tool holder part and second tool holder part, a fastener passage opening is provided in association with at least one fastener, and in the other replaceable tool holder part of the first tool holder part and second tool holder part, a fastener formfitting engagement opening is provided in association with each fastener passage opening of the one tool holder part.

11. The roller tool as claimed in claim 10, wherein in the first tool holder part, at least one fastener passage opening is respectively provided on both sides of the tool holder opening.

12. The roller tool as claimed in claim 1, wherein a tool support region facing away from the attachment region is provided on the tool holder.

13. The roller tool as claimed in claim 12, wherein the tool support region comprises a tool support surface that completely surrounds the tool holder opening, wherein a first tool support surface part is provided on the first tool holder part and a second tool support surface part is provided on the second tool holder part.

14. The roller tool as claimed in claim 12, wherein a tool holding formation is provided on the tool holder;

the replaceable tool having a tool shaft to be accommodated in the tool holder opening including a counter holding formation for engagement with a tool retaining formation provided on the tool shaft; and wherein when the tool holding formation is engaged with the counter holding formation, and the replaceable tool is pre-tensioned in contact with the tool support region.

15. A soil processing roller comprising a plurality of roller tools as claimed in claim 1, wherein the first tool holder parts of the roller tools are firmly attached to a carrier casing by welding.

16. The soil processing roller as claimed in claim 15, wherein the carrier casing is a roller casing of the soil processing roller, or in that the carrier casing is a cladding casing to be arranged surrounding the roller casing of the soil processing roller.

17. A soil processing machine comprising at least one soil processing roller as claimed in claim 15.

18. A method for attaching a replaceable tool to a tool holder of a roller tool as claimed in claim 1, comprising:

a) with the second tool holder part removed from the first tool holder part, inserting the tool shaft of the replaceable tool into a part of the tool holder opening formed in the first tool holder part, b) attaching the second tool holder part to the first tool holder part during or after inserting the tool shaft of the replaceable tool into the part of the tool holder opening formed in the first tool holder part.

19. The method as claimed in claim 18, wherein, the tool shaft is inserted into the part of the tool holder opening formed in the first tool holder part by moving it transversely to the opening longitudinal axis of the tool holder opening.

* * * * *